US005695842A

United States Patent [19]

Peck, Jr.

[11] Patent Number: 5,695,842

[45] Date of Patent: Dec. 9, 1997

[54] ENTRANCE GRATING

[75] Inventor: Ronald R. Peck, Jr., Pawling, N.Y.

[73] Assignee: Pawling Corporation, Pawling, N.Y.

[21] Appl. No.: 636,878

[22] Filed: Apr. 23, 1996

[51] Int. Cl.[6] ..... B32B 9/00

[52] U.S. Cl. ..... 428/52; 428/53; 428/58; 428/62; 428/83; 428/85; 428/192; 52/71; 52/117; 52/171; 52/181; 52/227; 52/664; 15/215; 15/238

[58] Field of Search ..... 428/52, 58, 192, 428/62, 53, 83, 85; 52/117, 181, 179, 664, 71, 227; 15/215, 238

[56] References Cited

U.S. PATENT DOCUMENTS

| | | | |
|---|---|---|---|
| 3,808,628 | 5/1974 | Betts | 15/215 |
| 4,276,728 | 7/1981 | Balzer et al. | 52/177 |
| 5,054,253 | 10/1991 | Bedics | 52/177 |
| 5,195,292 | 3/1993 | Bedics . | |

OTHER PUBLICATIONS

Balco Metalines, 12690/BAL, BuyLine 3670, pp. 7, 8, 9.
Arden, 12690/ARD, BuyLine 4184, pp. 6, 7.
Reese, 12690/REE, BuyLine 3090, pp. 8, 9.
The CS Group, 12690/CON, BuyLine 1011, p. 15.
K.N. Crowder, 12690/CRO, BuyLine 2186, p. 2.
Mats, Inc., 12690/MAT, BuyLine 1253, p. 2.
Ohio Gratings, Inc., 05532/OHI, BuyLine 2191, p. 3.

*Primary Examiner*—Patrick Ryan
*Assistant Examiner*—Abraham Bahta
*Attorney, Agent, or Firm*—Schweitzer Cornman Gross & Bondell LLP

[57] ABSTRACT

An entrance grating for office buildings is comprised of a series of closely spaced tread rail elements, forming the upper surface of the grating, and a plurality of support elements underneath the tread rail elements and tightly secured thereto at right angles. The tread rails are of extruded construction and include a hollow, tubular spine section for high strength and rigidity per unit of weight. The underlying support elements, also of extruded construction, are in the form of downwardly opening channel-shaped elements. High strength, expandable wall, blind fasteners are employed to secure the support elements to the tread rail elements at each of the crossing points to provide a strong, rigid assembly. The open bottoms of the channel-shaped supports may be closed by plastic pad strips providing resilient support and noise reduction.

10 Claims, 2 Drawing Sheets

ENTRANCE GRATING

BACKGROUND AND SUMMARY OF THE INVENTION

Entrance ways to office buildings, stores and the like frequently are provided with gratings, recessed into the flooring so as to be flush with the surface thereof, to facilitate the removal of debris, such as dirt, snow, water and the like from the footwear of pedestrian traffic entering the structure. Typical forms of such entrance gratings comprise a plurality of elongated tread rails arranged in side-by-side, parallel relation, with spacing being provided between adjacent tread rails and/or through openings being provided to accommodate the downward passage of debris into a recess or pit formed in the floor area to receive the grating. Frequently, such entrance gratings are custom designed to a particular size and/or a particular shape suitable for the architecture of the special entrance in which the gratings are installed.

In the design and construction of entrance gratings as described above, several factors need to be taken into consideration, some of which tend to be mutually conflicting. In this respect, the grating structure must be of very rugged design, capable of standing up to not only pedestrian traffic but occasional wheelchairs, hand trucks and the like. In addition, the grating structure, typically formed of metal components, must be relatively "quiet" to minimize or prevent annoying noise from the pedestrian traffic. The design must be aesthetically pleasing, consistent with the desires of the architect in providing an aesthetically pleasing entrance way. In addition to all of the foregoing, the design of the grating must be such as to accommodate economical custom manufacture and assembly in various sizes and shapes.

In accordance with the present invention, an improved entrance grating is provided, which is capable of easy and economical assembly yet which is extraordinarily rugged and durable and at the same time consistent with the aesthetic and ergonomic requirements of the installation. In a preferred embodiment of the invention, the grating comprises a plurality of elongated, flanged tread rails, arranged in side-by-side, parallel relation and supported from underneath by a plurality of elongated support members, disposed at right angles to the tread rails and tightly secured thereto at crossing locations to form a rigid structure. To particular advantage, each of the flanged tread rails, comprised of aluminum extrusions, are formed with an integral tubular spine section, providing an unusually strong, lightweight, rigid configuration of the tread rail. The tubular spine section defines a base surface for the tread rail for contacting engagement with the crossing support members underneath.

In a preferred form of the invention, the support members are in the form of downwardly opening channel-shaped elements, also preferably of extruded aluminum. At each of the crossing points, where the channel-shaped supports intersect with the tubular tread rail spines, a hole is drilled through the top wall of the downwardly opening support and through the bottom wall of the tubular spine section. The two elements are then secured together at each such crossing point by high strength blind fasteners, which can be inserted through the support member and into the interior of the closed tubular spine, and then expanded internally of the spine to provide a tight, rugged joint with an economical assembly procedure.

To particular advantage, the downwardly opening, channel-shaped supports of the grating structure are closed by means of plastic covers, which provide a resilient base for the grating, minimizing shock loading and noise.

Depending upon the service requirements of the grating structure, the flanged tread rails may be provided with a wide variety of tread inserts, Such as vinyl, carpet, brush, or even metal inserts.

For a more complete understanding of the above and other features and advantages of the invention, reference should be made to the following detailed description of a preferred embodiment of the invention and to the accompanying drawings.

DESCRIPTION OF PREFERRED EMBODIMENTS

Figure 1:
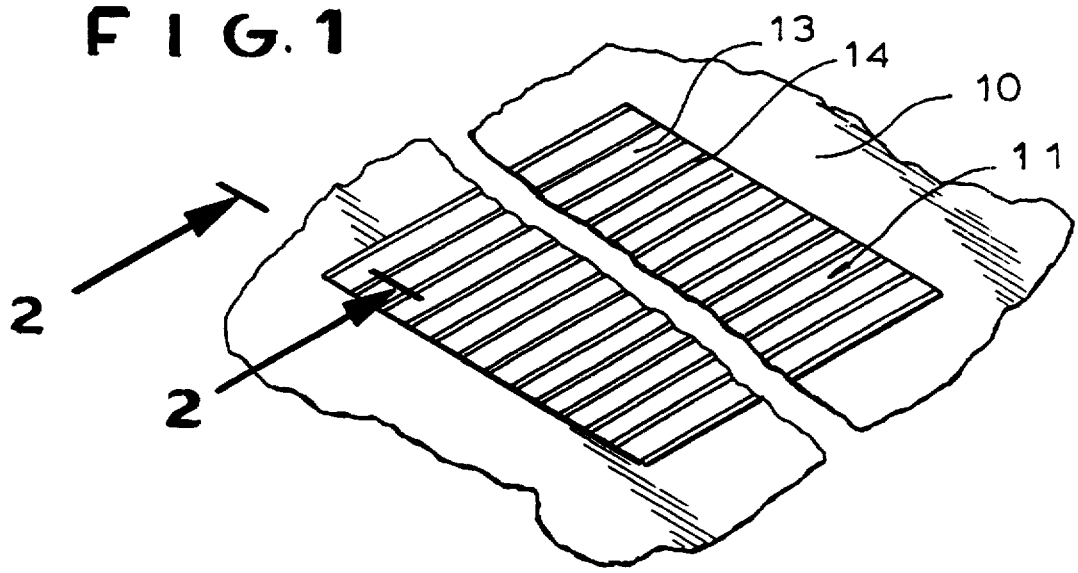
FIG. 1 is a perspective illustration of a small recessed entrance grating according to the invention.
Figure 3:
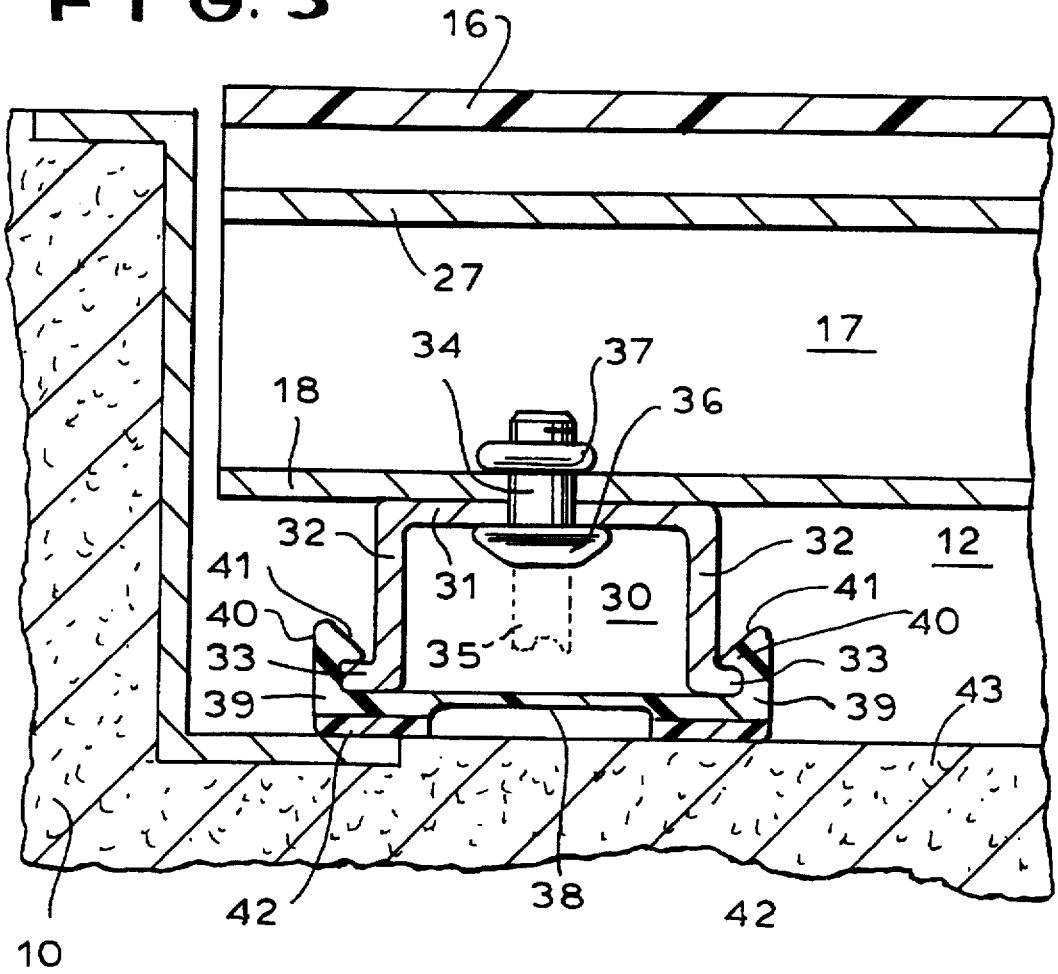
FIG. 3 is an enlarged, fragmentary cross sectional view as taken generally on line 3—3 of FIG. 2.

Referring now to the drawing, FIG. 1 illustrates a building entrance floorway or the like 10 in which an entrance grating 11 is installed. The grating is received in a recess 12 provided in the floor, such that the upper surface of the grating is substantially flush with the surface of the floor. The grating includes a plurality of tread rail assemblies 13 placed side-by-side with a narrow space 14 between each rail. Typically, the tread rail assemblies 13 are placed crosswise (i.e., at right angles) to the normal direction of pedestrian traffic.

Figure 2:
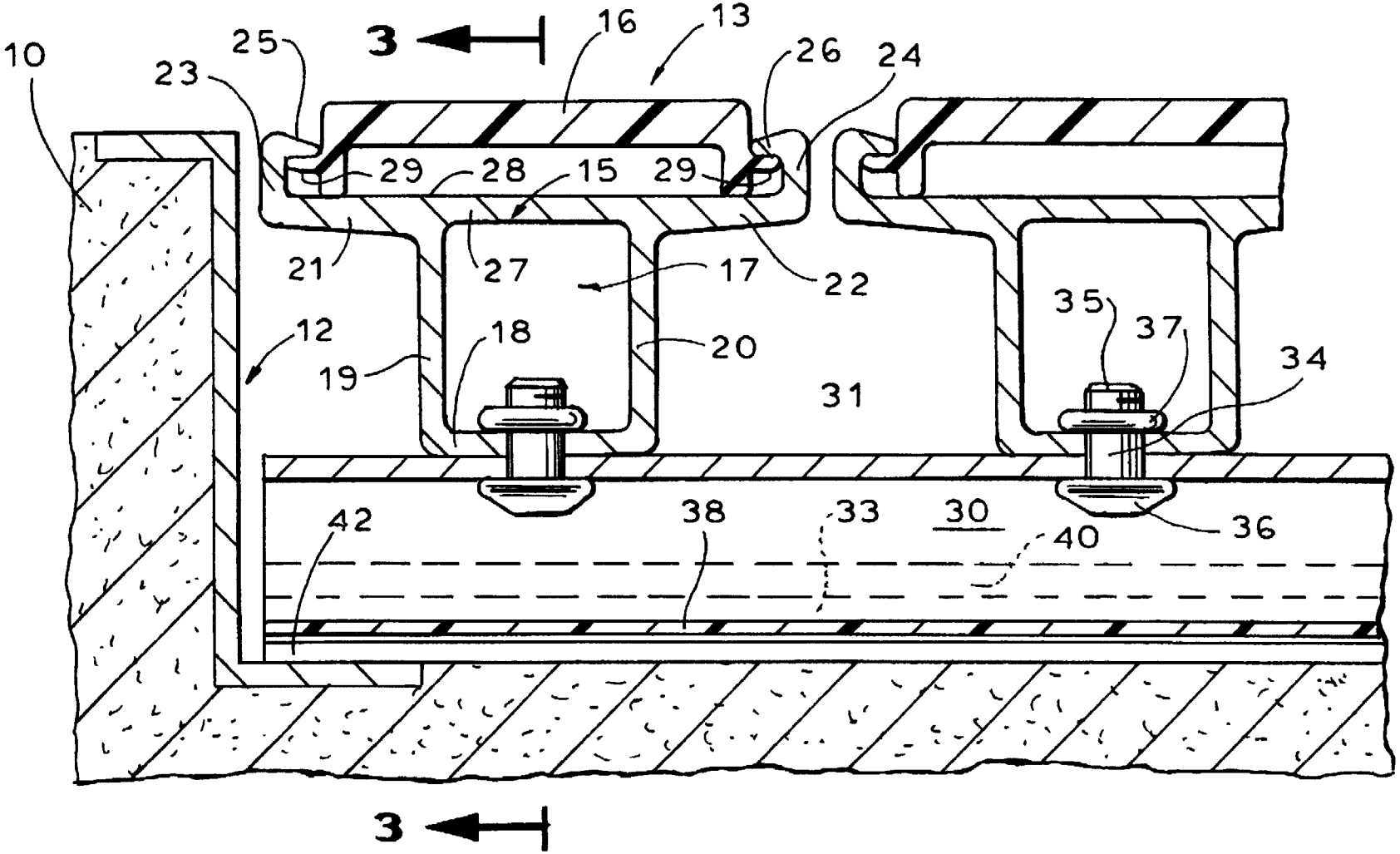
FIG. 2 is a greatly enlarged, fragmentary cross sectional view of the new entrance grating, as taken generally on line 2—2 of FIG. 1.

As shown in FIG. 2, each of the tread rail assemblies 13 is comprised of a tread rail element 15 and a tread strip 16. The tread rail 15 is of one piece, extruded construction, typically of aluminum. In accordance with one aspect of the invention, the tread rail includes a hollow tubular spine section 17, preferably of rectangular configuration, including a generally flat bottom wall 18 and spaced-apart, generally vertical sidewalls 19, 20. Opposed tread flanges 21, 22, formed with upstanding sidewalls 23, 24 and inwardly directed retaining flanges 25, 26, extend laterally from opposite sides of the tubular spine section 17, giving the tread rail a generally T-shaped cross section. Outwardly extending portions of the tread flanges define, together with an upper wall 27 of the tubular spine, a generally flat, horizontal support surface 28. The tread strips 16, which may be of various materials known for the purpose, are inserted in the upper portion of the tread rail 15, being supported on the surface 28 and having outwardly extending retaining flanges 29 engaged by the inwardly directed tread rail flanges 25, 26. Typical materials for the treat strips are vinyl, carpet, brush and metal.

Although specific dimensions are not critical to the invention, a typical and preferred form of tread rail 15 may have an overall width of about 1⅜ inch, and an overall height of about ⅞ of an inch. The integral tubular spine 17 may have a typical overall height of about 0.65 inch and a typical width of about 0.6 inch, with extruded side, top and bottom walls of about 0.06 inch.

In a typical entrance grid assembly, a series of the tread rail assemblies 13 are arranged in side-by-side, parallel, closely spaced relation, with for example about ⅛ inch separation between adjacent tread rails, substantially as shown in FIG. 2. The tread rails are secured in this arrangement by means of tread rail supports 30, also preferably of extruded aluminum construction. The tread rail supports 30 are arranged at right angles to the tread rail assemblies 13 and can be spaced apart a substantially greater distance, depending somewhat on expected loads to be applied. In a typical case, the supports 30 may be spaced on eight inch centers, for example. Representative dimensions of the tread rail supports 30, which are intended to be representative and not limiting, are approximately 1¼ quarter inches overall width and 0.5–0.6 inches in height, with extruded wall thickness of about 0.06 inch. In the illustrated arrangement, the tread rail supports are formed with a generally flat, horizontal upper wall 31, spaced-apart generally vertical sidewalls 32 and outwardly extending foot flanges 33 at the lower extremities of the sidewalls 32.

Pursuant to one aspect of the invention, the channel-shaped tread supports 30 are secured to the tread rails 15 at each crossing point, by means of high compression expanding wall, blind fasteners 34. The fasteners 34 most advantageously are of a commercially available type, known as "Magna-Bulb", marketed commercially by Huck International Inc., of Irvine, Calif. Installation of the Magna-Bulb fasteners involves an initial assembly of the tread rails in a suitable fixture (not shown), with an upside-down orientation, and placement of the channel-shaped supports 30 against the bottom walls 18 of the tubular spines 17. A hole of appropriate size to closely receive an undistorted Magna-Bulb fastener is drilled through the top wall 31 of the support and the bottom wall 18 of the tread rail spine. The Magna-Bulb fastener is inserted through the hole, and a predetermined length of the fastener projects into the closed tubular interior of the tread rail spine 17. A draw rod 35, forming part of the Magna-Bulb fastener and initially projecting out from the head 36 of the fastener, is engaged by a suitable tool (not shown) provided for the purpose, which withdraws the rod 35 under steady, controlled pressure, causing the sidewall of the fastener to collapse on the inside of the spine 17, as indicated at 37. The Magna-Bulb fastener, installed in accordance with manufacturer's specifications, provides an exceptionally strong and tight connection at each of the crossing points. In addition, the assembly can be carried out quickly and efficiently with two operations: drilling of the hole and installation of the Magna-Bulb fastener, both of which can be carried out rapidly with a high level of confidence that the completed joint will be tight, secure and durable.

In addition to the above described efficiencies and advantages of employing the Magna-Bulb fastener, the arrangement enables the tread rails 15 to be constructed with a closed, tubular spine 17, which imparts great strength to the tread rails, in relation to the weight of materials employed. This works to particular advantage in distributing the typically concentrated pedestrian load over a wide support area underneath.

In a particularly preferred embodiment of the invention, the lower open end of each channel-shaped tread support mounts a pad strip 38, which is preferably of extruded plastic construction. The pad strip 38 is formed at its side edges with upwardly extending flange walls 39 joined by inwardly projecting flanges 40 arranged to engage and overlie the foot flanges 33 of the tread supports. To advantage, the upper surfaces of the flanges 40 are disposed at an angle to form cam surfaces 41. The arrangement is such that the pad strip 38 may be pressed onto the open side of the tread support 30 causing the cam surfaces 41 to outwardly displace the upright walls 39 sufficiently to clear the foot flanges 33.

In the illustrated form of the invention, the pad strip 38 can be formed of a generally rigid plastic material, such as rigid vinyl, but is provided at each side with a coextruded pad 42 of a softer material which contacts the floor 33 of the recess providing both a greater degree of resilient support and additional sound deadening.

An entrance gratings constructed in accordance with the invention is uniquely advantageous in providing for a significantly superior grid structure, while at the same time accommodating efficient and economical manufacture. Construction of the individual tread rail elements to have an integral, hollow tubular spine provides for individual tread strips that are exceptionally rigid and rugged in relation to the weight of material employed. Additionally, joining the tread rails to the underlying support structure by means of high strength, expanding wall, blind fasteners, enables assembly of the complete grid structure to be completed rapidly and efficiently, with assurance that the individual joints will be very tight and strong. This provides for a rigid and tight grid assembly, with minimum tendency for racking under load. The tight crossover connections also assure that there is minimum noise generation at these points during usage of the grid assembly.

Resilient support and further quieting are conveniently provided through the use of snap-on pad strips, which underlie the lower portions of the channel-shaped tread support elements. A particularly advantageous arrangement is provided by an arrangement of elongated pad strips, which may be pressed on over laterally extending foot flanges at the lower edges of the tread support elements, providing for expedited assembly and a neat appearing and functional pad arrangement. Optimum resilience and quieting effect is achieved by coextruding, on the bottom surface of the pad strips, softer and more resilient pad areas for contacting the underlying support surface.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An entrance grating of the type comprising a plurality of elongated tread rail elements positioned in parallel, side-by-side relation, a plurality of elongated tread supports oriented at an angle to said tread rail elements and positioned thereunder at spaced intervals, and means for securing said supports to said tread rail elements at crossing points to form a rigid grating structure, characterized by (a) said tread rail elements being of one-piece, extruded construction and comprising an integral, substantially closed tubular spine section defining base surface portions for engagement with said elongated supports, (b) each said tread rail element having opposed integral tread flanges extending from upper portions of said tubular spine section, (c) said tread supports being of rigid construction and being generally of inverted U-shaped cross section, (d) upper surface portions of said tread supports engaging and supporting said base surface portions of said tread rail elements, (e) said upper surface portions and said base surface portions, at regions of mutual engagement thereof, being formed with aligned openings therethrough, said openings being located at spaced intervals along the lengths of said upper surface portions and said base surface portions, and (f) expandable wall blind fasteners being positioned in said aligned openings and having wall portions thereof within said tubular spine sections expanded and drawn toward said supports, whereby to tightly secure said tread rail elements to said support elements at said crossing points.

2. An entrance grating according to claim 1, wherein (a) said tread rail elements define an upwardly opening channel for the locking reception of tread strips.

3. An entrance grating according to claim 1, wherein (a) said support elements include spaced-apart downwardly extending wall portions, and (b) plastic pads are secured over lower extremities of said downwardly extending wall portions for cushioning said grating.

4. An entrance grating according to claim 3, wherein (a) said downwardly extending wall portions define open bottom portions of said support elements, and (b) said plastic pads comprise longitudinally extending strip elements extending laterally between the spaced-apart downwardly extending wall portions of said support elements and forming cover means for said open bottom portions.

5. An entrance grating according to claim 4, wherein (a) said downwardly extending wall portions are provided at lower extremities thereof with outwardly extending foot flanges, and (b) said strip plastic pad elements include first flange portions extending upward adjacent outer edge portions of said foot flanges and second flange portions extending inwardly over upper surface portions of said foot flanges.

6. An entrance grating according to claim 4, wherein (a) said strip plastic pad elements are coextruded of plastic materials, with a relatively harder plastic material forming upper portions of said pad elements and a relatively softer plastic material forming lower portions of said pad elements.

7. An entrance grating according to claim 6, wherein (a) spaced apart areas of said relatively softer plastic material are positioned substantially directly underneath said downwardly extending wall portions.

8. An entrance grating according to claim 1, wherein (a) said tubular spine section being of closed, generally rectangular configuration, with spaced-apart side walls and spaced-apart upper and lower walls, (b) said lower wall defining said base surface portions.

9. An entrance grating according to claim 8, wherein (a) said integral tread flanges have upper surface portions defining, together with said upper wall, a bottom wall portion of a tread receiving channel, (b) said tread flanges further having spaced apart flange portions forming opposite sides of said tread receiving channels, and (c) tread strips are received in said tread receiving channels.

10. An entrance grating according to claim 1, wherein (a) said tread flanges extend laterially from upper portions of said tubular spine, to form tread rail elements of generally T-shaped cross section.

* * * * *